US006480572B2

(12) United States Patent
Harris et al.

(10) Patent No.: US 6,480,572 B2
(45) Date of Patent: Nov. 12, 2002

(54) DUAL FILAMENT, ELECTROSTATICALLY CONTROLLED FOCAL SPOT FOR X-RAY TUBES

(75) Inventors: Jason P. Harris, Schaumburg, IL (US); Salvatore Perno, Winfield, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/802,517

(22) Filed: Mar. 9, 2001

(65) Prior Publication Data

US 2002/0126798 A1 Sep. 12, 2002

(51) Int. Cl.[7] ..... H01J 35/06
(52) U.S. Cl. ..... 378/136; 378/138
(58) Field of Search ..... 378/119, 121, 378/134, 136, 138

(56) References Cited

U.S. PATENT DOCUMENTS

| | | | | | |
|---|---|---|---|---|---|
| 4,315,154 | A | * | 2/1982 | Weigl et al. | 378/115 |
| 4,637,040 | A | | 1/1987 | Sohval et al. | 378/9 |
| 4,689,809 | A | | 8/1987 | Sohval | 378/136 |
| 5,007,074 | A | | 4/1991 | Furbee et al. | 378/138 |
| 5,065,420 | A | | 11/1991 | Levene | 378/137 |
| 5,125,019 | A | | 6/1992 | Evain et al. | 378/137 |
| 5,303,281 | A | * | 4/1994 | Koller et al. | 378/113 |
| 5,313,510 | A | | 5/1994 | Ebersberger et al. | 378/137 |
| 5,581,591 | A | | 12/1996 | Burke et al. | 378/135 |
| 5,621,781 | A | * | 4/1997 | Blake et al. | 378/136 |
| 5,623,530 | A | * | 4/1997 | Lu et al. | 378/136 |
| 5,633,907 | A | | 5/1997 | Gravelle et al. | 378/121 |
| 5,742,662 | A | | 4/1998 | Kuhn et al. | 378/138 |
| 5,768,331 | A | | 6/1998 | Gordon et al. | 378/19 |
| 5,812,632 | A | | 9/1998 | Schardt et al. | 378/137 |
| 5,910,974 | A | | 6/1999 | Kuhn et al. | 378/138 |
| 6,333,969 | B1 | * | 12/2001 | Kujirai | 313/421 |

* cited by examiner

*Primary Examiner*—David P. Porta
(74) *Attorney, Agent, or Firm*—Fay, Sharpe, Fagan, Minnich & Mckee, LLP

(57) ABSTRACT

A dual filament x-ray tube assembly (16) includes an evacuated envelope (52) having an anode (54) disposed at a first end of the evacuated envelope (52) and a cathode assembly (62) disposed at a second end of the evacuated envelope (52). The cathode assembly includes a variable-length filament assembly (72, 74; 100) which emits electron beams for impingement on the anode (54) at focal spots having varying lengths. The cathode assembly (62) further includes a cathode cup (64, 66, 68; 110, 112) which is subdivided into a plurality of electrically insulated deflection electrodes (64, 66, 68; 110, 112). A filament select circuit (80) selectively and individually heats a portion of the variable-length filament assembly (72, 74). Electron beams emitted from the filament assembly (72, 74) are electrostatically focused and controlled by applying potentials to different ones of the deflection electrodes (64, 66, 68; 110, 112). The x-ray tube assembly (16) provides longer focal spots for thick-slice scanning applications and shorter focal spots for thin-slice scanning applications along with the benefit of electrostatic focusing and control.

35 Claims, 8 Drawing Sheets

DUAL FILAMENT, ELECTROSTATICALLY CONTROLLED FOCAL SPOT FOR X-RAY TUBES

BACKGROUND OF THE INVENTION

The present invention relates to the x-ray tube art. It finds particular application in conjunction with high power x-ray tubes for use with CT scanners and the like and will be described with particular reference thereto. It is to be appreciated, however, that the invention will also find application in conjunction with conventional x-ray diagnostic systems and other penetrating radiation systems for medical and non-medical examinations.

Typically, a high power x-ray tube includes an evacuated envelope or housing which holds a cathode filament through which a heating or filament current is passed. A high potential, typically on the order of 100–200 kV, is applied between the cathode and an anode which is also located within the evacuated envelope. This potential causes a tube current or beam of electrons to flow from the cathode to the anode through the evacuated region in the interior of the evacuated envelope. The electron beam impinges on a small area or focal spot of the anode with sufficient energy to generate x-rays.

In order to increase the resolution of a CT scanner, it is desirable to modulate the position or size of the focal spot between two or more positions or sizes, creating two distinct point sources of radiation. Conventionally, two different methods have been employed to control the position and/or width of the focal spot. One method of focal spot control employs electrostatic grids or biasing electrodes referenced to a common leg of a single filament. The voltages on the two electrostatic grids are varied to change the location, as well as the width, of the electron beam impinging on the focal track of the anode. While the electrostatic method yields greater focal position control, it is limited to providing a focal spot of a single length.

Another method of focal spot control employs a magnetic yoke in order to create a magnetic field that affects the path of the electron beam emitted from the cathode. While the magnetic yoke method employs two filaments, therefore providing two focal spot lengths and widths, it is disadvantageous for a number of reasons. The magnetic yoke tube requires two additional connections to be passed through the x-ray tube housing, making it incompatible with many CT systems. In addition, the magnetic fields employed to deflect and focus the electron beam cannot be moved in a square wave fashion between the two focal spot positions, creating a gap in the collected data.

Therefore, a need exists for an x-ray tube assembly that provides multiple focal spot lengths and widths to create a system having a high modulation transfer function as well as a high x-ray flux in order to limit exposure times. The present invention contemplates a new and improved x-ray tube having an adjustable focal spot length and width, which overcomes the above-referenced problems and others.

SUMMARY OF THE INVENTION

In accordance with one aspect of the present invention, an x-ray tube assembly includes an evacuated envelope and an anode disposed at a first end of the evacuated envelope for rotation about an anode axis. A cathode assembly disposed at a second end of the evacuated envelope emits an electron beam which strikes the anode at a focal spot, having a focal spot length and a focal spot width. The cathode assembly includes a variable-length filament assembly which emits electron beams, which impinge on the anode at focal spots having variable lengths. A cathode cup defines a plurality of electrostatic deflection electrodes which are electrically insulated from each other. Further, potentials are individually and selectively applied to different ones of the electrostatic electrodes of the cathode cup for controlling the width and location of the focal spot on the anode.

In accordance with another aspect of the present invention, an x-ray tube includes a cathode assembly having a long filament portion and a short filament portion and a common electrostatic deflection electrode disposed between the long and short filament portions. A first electrostatic deflection electrode is disposed adjacent the long filament portion opposite the common electrode and a second electrostatic deflection electrode is disposed adjacent the short filament portion opposite the common electrode. The x-ray tube further includes an anode and a vacuum enclosure which encloses the cathode assembly and the anode.

In accordance with another aspect of the present invention, an x-ray tube with an adjustable length and width focal spot includes an anode and a cathode assembly, which includes at least two filament segments and electrostatic deflection electrodes. A vacuum envelope surrounds the cathode assembly and the anode. Not more than four leads pass through the vacuum envelope to apply electrical power to the filament sections and bias potentials to the electrodes. A filament selection circuit is disposed inside the vacuum envelope in connection with the four leads passing through the vacuum envelope. The filament selection circuit is connected with the filament segments for applying electric current selectively through a long section of filament and a short section of filament in order to control focal spot length. Further, the filament selection circuit is connected with the electrodes in order to select focal spot width end position.

In accordance with another aspect of the present invention, an x-ray tube assembly includes an evacuated envelope having an electron-emitting cathode assembly spaced apart from a rotating anode, where the cathode assembly includes at least a first filament and a second filament for emitting electrons in a beam which impinges on the anode at a focal spot having a variable length and a variable width. A cathode cup is sub-divided into at least three electrically insulated deflection electrodes. A filament select circuit is disposed adjacent the evacuated envelope. The filament select circuit includes means for selectively and individually electrically heating one of the first and second filaments and means for individually and selectively applying potentials to different ones of the electrostatic deflection electrodes in order to control a width and a location of a focal spot on the anode.

In accordance with another aspect of the present invention, a computerized tomographic system includes a source of penetrating radiation for transmitting radiation through a subject disposed in a subject receiving aperture. The source includes at least two point sources of radiation, each providing beams of radiation having different focal lengths. Detector means are coupled to the source for detecting radiation emitted from the source after passage of the radiation through the subject. The source and detector means are mounted on a rotatable gantry. The system further includes means for processing the detected radiation into a tomographic image representation.

In accordance with a more limited aspect of the present invention, the source of penetrating radiation includes an evacuated envelope and an anode disposed at a first end of the evacuated envelope. A cathode assembly is disposed at a second end of the evacuated and includes a cathode base portion and at least a first filament and a second filament, where the first filament is longer than the second filament. At least three deflection electrodes are attached to and electrically insulated from the cathode base portion. The source further includes means for individually and selectively applying potentials to different ones of the deflection electrodes.

In accordance with another aspect of the present invention, an x-ray tube includes an evacuated envelope having a cathode spaced apart from an anode adapted to be maintained at a positive voltage relative to the cathode. The cathode includes a filament assembly for selectively emitting electrons in a beam which impinges on the anode at a focal spot having at least one of a long focal spot length and a short focal spot length and a variable focal spot width, and a cathode cup having a plurality of parts electrically insulated from each other. A method of operating the x-ray tube includes the steps of selectively heating a portion of the variable filament assembly to emit electrons in the beam having one of the short focal spot length and the long focal spot length. The method further includes individually and selectively applying potentials to different ones of the cathode cup parts for controlling the width and location of the focal spot on the anode.

One advantage of the present invention resides in obtaining a higher x-ray flux without overheating the anode track.

Another advantage of the present invention is that it produces x-ray radiation having multiple focal spot lengths.

Another advantage of the present invention resides in the presence of multiple filaments without additional external connections between the x-ray tube and the CT system.

Another advantage of the present invention resides in the combination of filament length selection and electrostatic focusing.

Yet another advantage of the present invention resides in selective excitation of one of multiple filaments.

Still another advantage of the present invention is that it modulates the focal spot between two or more positions providing greater sampling density.

Other benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
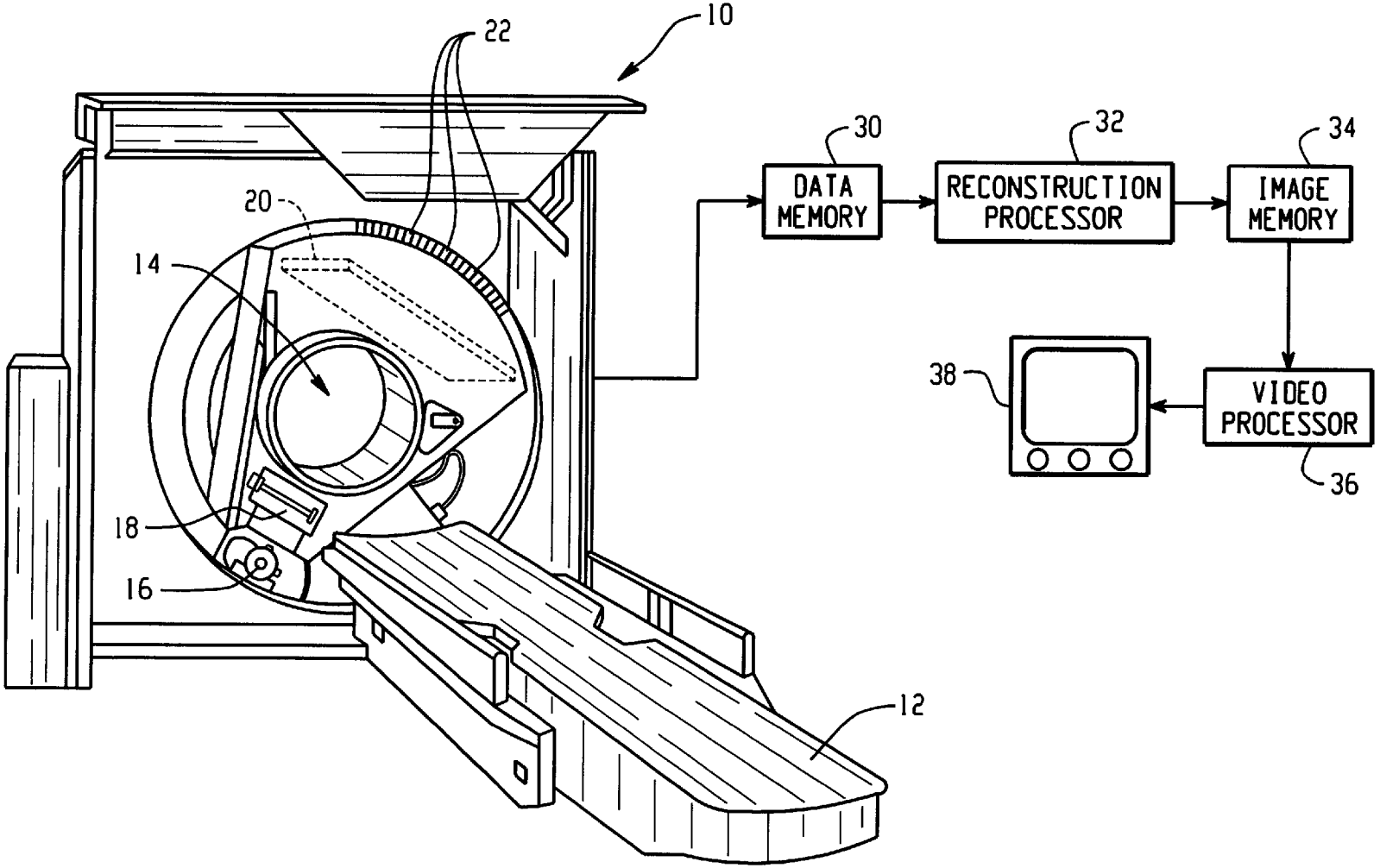
Fig. 1 PRIOR ART
FIG. 1 is a diagrammatic illustration of a prior art computerized tomographic (CT) diagnostic system employing the x-ray tube assembly in accordance with the present invention.

With reference to FIG. 1, a computerized tomographic (CT) scanner 10 radiographically examines and generates diagnostic images of a subject disposed on a patient support 12. More specifically, a volume of interest of the subject on the support 12 is moved into an examination region 14. An x-ray tube assembly 16 mounted on a rotating gantry projects one or more beams of radiation through the examination region 14. A collimator 18 collimates the beams of radiation in one dimension. In third generation scanners, a two-dimensional x-ray detector 20 is disposed on the rotating gantry across the examination region 14 from the x-ray tube. In fourth generation scanners, a ring or array of two-dimensional detectors 22 is mounted on the stationary gantry around the rotating gantry.

Each of the two-dimensional x-ray detectors 20, 22 includes a two-dimensional array of photodetectors connected or preferably integrated into an integrated circuit. The detectors generate electrical signals indicative of the intensity of the received radiation which is indicative of the integrated x-ray absorption along the corresponding ray between the x-ray rube and the scintillation crystal segment.

The electrical signals, along with information on the angular position of the rotating gantry, are digitized by analog-to-digital converters. The digital diagnostic data is communicated to a data memory 30. The data from the data memory 30 is reconstructed by a reconstruction processor 32. Various known reconstruction techniques are contemplated including spiral and multi-slice scanning techniques, convolution and back projection techniques, cone beam reconstruction techniques, and the like. The volumetric image representation generated by the reconstruction processor 32 is stored in a volumetric image memory 34. A video processor 36 withdraws selective portions of the image memory to create slice images, projection images, surface renderings, and the like and reformats them for display on a monitor 38, such as a video or LCD monitor.

Figure 2:
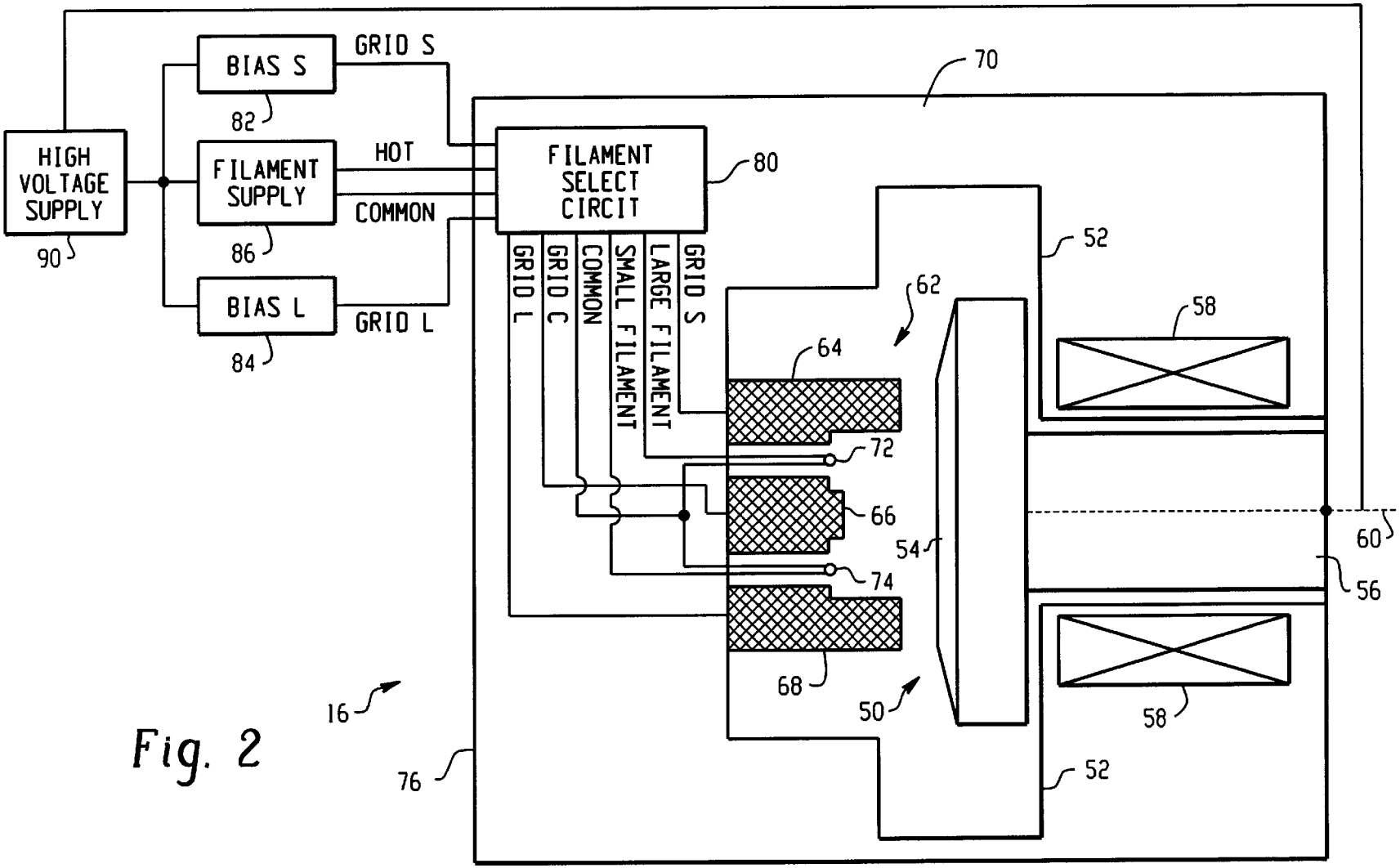
FIG. 2 is a diagrammatic illustration of a preferred embodiment of the x-ray tube assembly in accordance with the present invention.

With reference to FIG. 2 and continuing reference to FIG. 1, the x-ray tube assembly 16 includes an anode 50 and a cathode assembly 62, which are located at opposite ends of an evacuated envelope 52. The evacuated envelope 52 is evacuated such that an electron beam passes from the cathode assembly 62 to a focal spot on an annular, circumferential face 54 of the anode 50. The anode 50 includes a rotor 56, which is driven by a rotational driver 58, for rotation about an anode axis 60. Preferably, the evacuated envelope 52 is disposed in a dielectric medium 70, such as an oil-based dielectric fluid, which is circulated to a cooling means.

Figure 3A:
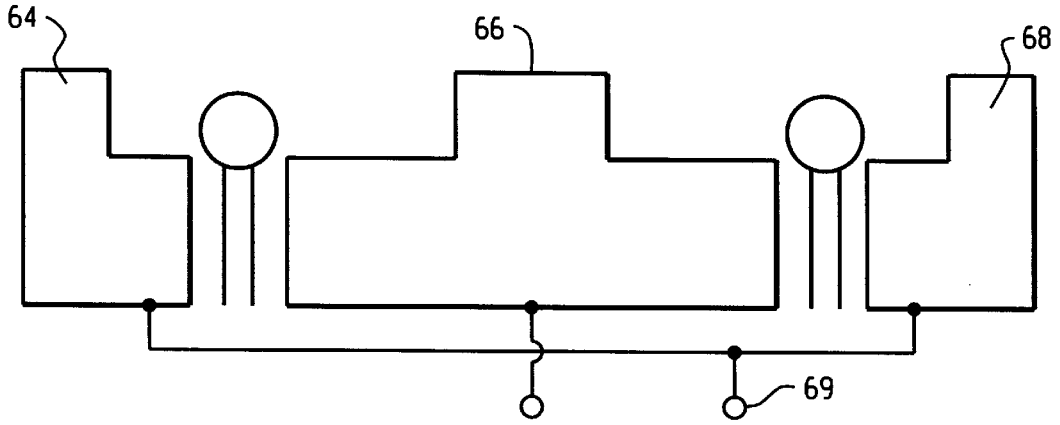
FIGS. 3A–3E are diagrammatic illustrations of preferred embodiments of the cathode assembly in accordance with the present invention.

The cathode assembly 62 is located on the other end of the evacuated envelope 52. In one embodiment, the cathode assembly 62 includes a cathode cup, which is subdivided into three voltage biasing or deflection electrodes 64, 66, 68. In one embodiment, the two side deflection electrodes 64, 68 and one center deflection electrode 66 are electrically insulated from each other, as shown in FIG. 2. In an alternate embodiment, shown in FIG. 3A, the two side deflection electrodes 64, 68 are electrically connected to one another and to a common voltage source through electrical lead 69. As is described more fully below, the deflection electrodes 64, 66, 68 are selectively powered, through a filament select circuit 80, by a pair of deflection electrode power supplies 82, 84 and a filament power supply 86, all of which are switchably connected to a high voltage supply 90.

Figure 3C:
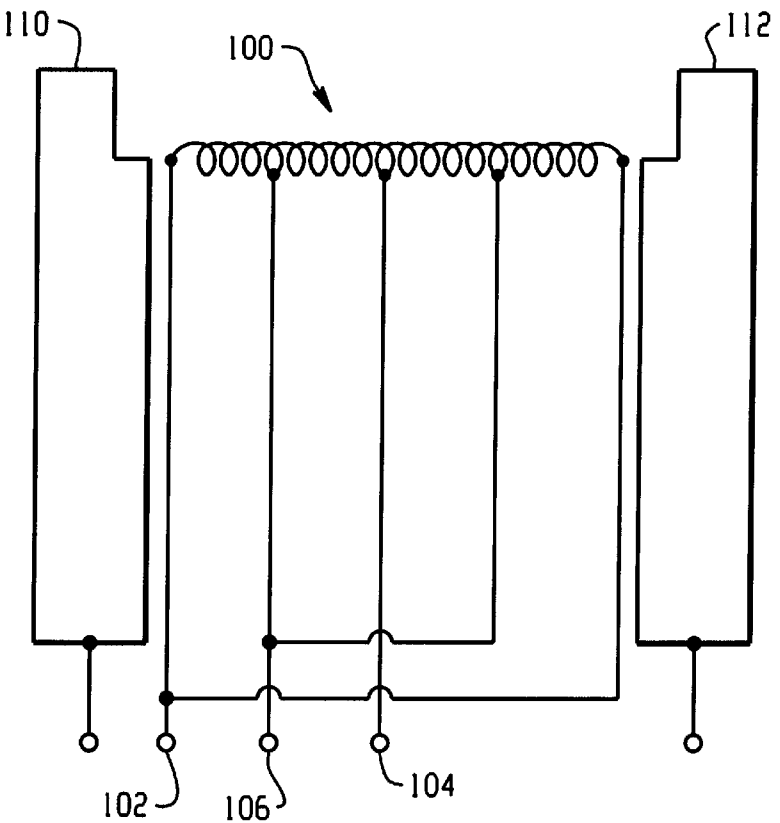
Figure 3B:
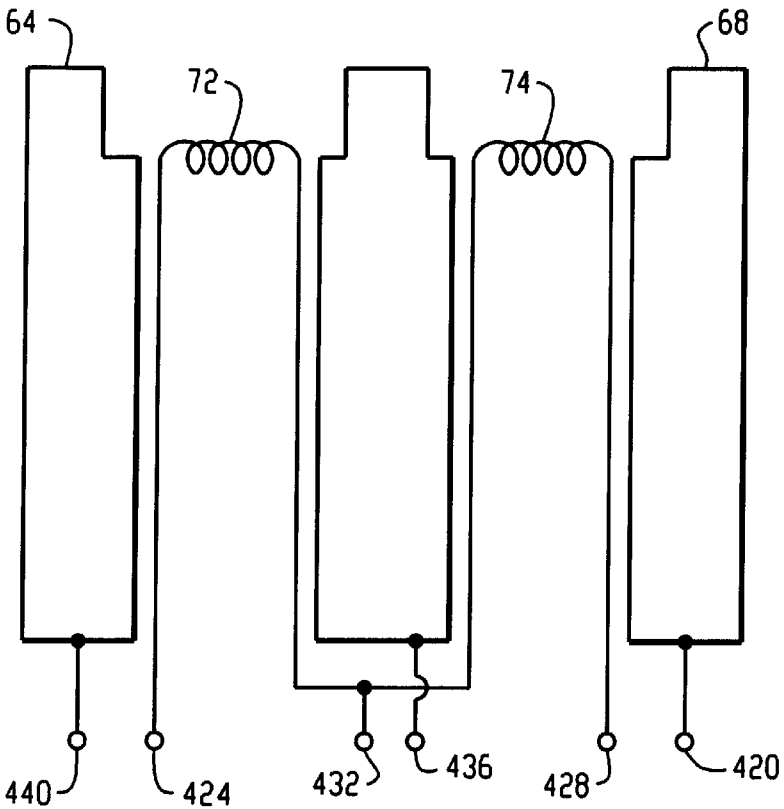

With reference to FIGS. 3B and 3C and continuing reference to FIG. 2, the cathode assembly 62 includes a variable-length filament assembly. The variable-length filament assembly emits electron beams which impinge on the anode 50 at focal spots of varying lengths and widths. In one embodiment, shown in FIG. 3B, the variable-length filament assembly includes two filaments 72, 74 of different lengths, each producing focal spots of different lengths. Each filament 72, 74 of the filament assembly is electrically insulated from the deflection electrodes 64, 66, 68. As is described more fully below, the filaments 72, 74 are selectively excited based on the desired imaging application. Although thin wire filaments are illustrated, it is to be appreciated that the filaments can also be thin metallic layers deposited on an insulating substrate.

In an alternate embodiment, shown in FIG. 3C, the variable-length filament assembly includes a single tapped filament 100 that is electrically insulated from two deflection electrodes 110, 112. The tapped filament 100 includes three filament leads, a first filament lead 102, a second or common filament lead 104, and a third filament lead 106. The first filament lead 102 is in electrical communication with opposite ends of the tapped filament 100. The second or common filament lead 104 is in electrical communication with the center of the tapped filament 100. When current flows through electrodes 102, 104, the entire length of the filament is heated to emit electrons. As shown in FIG. 3C, the third filament lead 106 is in electrical communication with the tapped filament 100 at points between the first filament leads and symmetric about the common lead. In one embodiment, the filament leads 102, 104, 106 are electrically connected to the tapped filament 100 via solder joints or welds. However, it is to be appreciated that the filament leads may be electrically connected to the tapped filament in a variety of conventional manners.

In the embodiment of FIG. 3C, either the entire filament length 100, lying between filament leads 102, or a portion of the filament length, lying between leads 106, may be excited depending on the particular diagnostic application. With age, the filament resistance increases. Positioning the filament portion that is common to both the long and short modes in the center assures that if its resistance increases, the corresponding higher electron generation will be symmetric in the center of the beam.

Figure 3E:
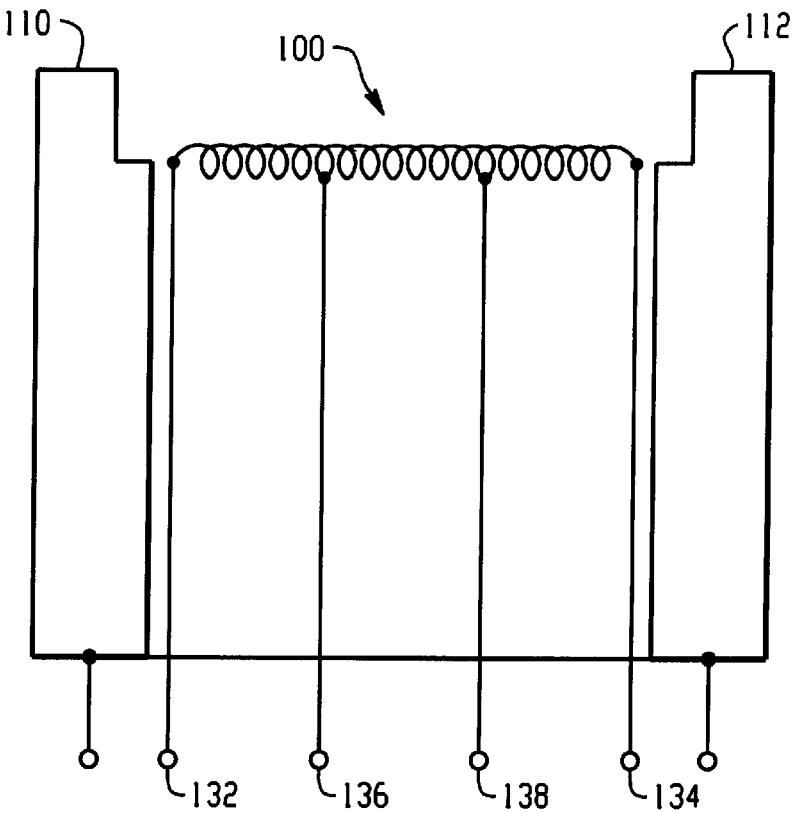
Figure 3D:
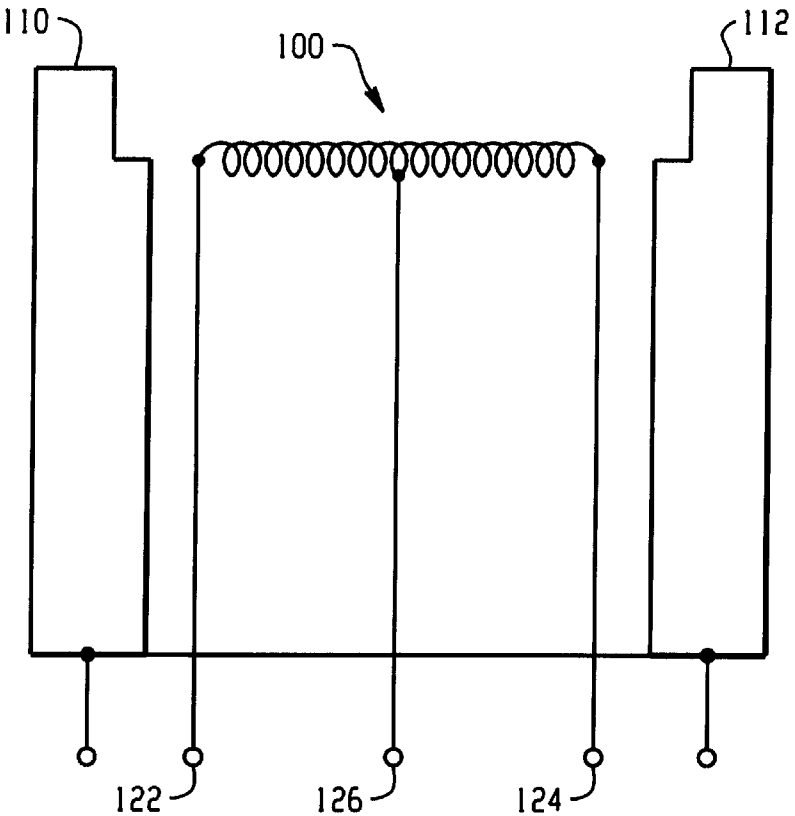

In an alternate embodiment, shown in FIG. 3D, the tapped filament 100 includes three filament leads, a first filament lead 122, a second filament lead 126, and a common filament lead 124. The first filament lead 122 is in electrical communication with a first end of the tapped filament 100. The common filament lead 124 is in electrical communication with the other end of the tapped filament 100. As shown in FIG. 3D, the second filament lead 126 is in electrical communication with the tapped filament at a point between the first and second filament leads. When current flows through leads 122, 124, the entire length of the filament is heated to emit electrons. When current flows through leads 126, 124, only a portion of the filament is heated to emit electrons.

In the alternate embodiment illustrated in FIG. 3E, the tapped filament 100 includes four filament leads 132, 134, 136, 138 in electrical communication therewith. When current flows through leads 132, 134, the entire length of the filament is heated to emit electrons, resulting in x-rays having a longer focal length. Conversely, when current flows through leads 136, 138, the center portion of the filament is heated to emit electrons, resulting in x-rays having a shorter focal length.

Voltages are applied to the two deflection electrodes 110, 112 and varied in the form of a square wave having a 180° phase shift between the two electrodes. It is to be appreciated that the electrode voltages may be varied according to other waveforms as well. The oscillating voltages on the deflection electrodes cause the emitted electron beam to oscillate between two impingement positions on the rotating anode, hence the origin of the x-ray beam to shift between two origins.

Figure 4:
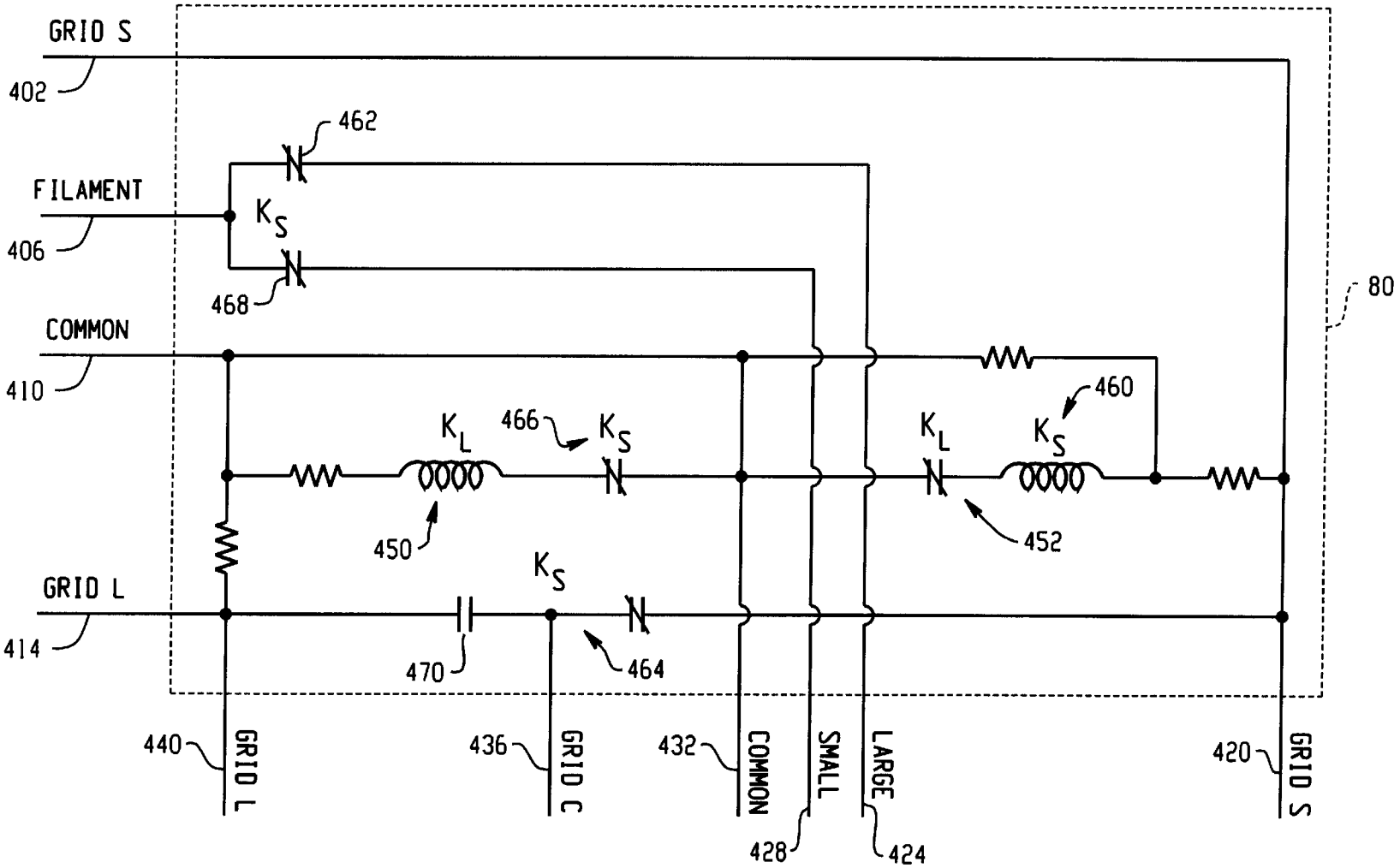
FIG. 4 is a diagrammatic illustration of a filament select circuit in accordance with the present invention.

With reference to FIG. 4 and continuing reference to FIG. 2, the cathode assembly 62 is controlled by a filament select circuit 80, which is located within the x-ray tube housing 76. In one embodiment, the filament select circuit 80 includes four inputs 402, 406, 410, 414 and six outputs 420, 424, 428, 432, 436, 440 to the cathode assembly (not shown). It is to be appreciated that having four inputs to the x-ray tube assembly facilitates compatibility with a variety of conventional x-ray and CT systems. In other words, no external connections between the x-ray tube assembly and the x-ray system need to be changed or added.

The filament select circuit 80 provides selective and individual heating of one of the two filaments 72, 74 depending upon the desired focal spot length necessary for a particular application. The desired filament is selected by the order in which the end deflection electrodes 64, 68 are turned on or powered. More particularly, powering the large deflection electrode 68 first (via input 414) enables the large filament 74, while turning on the small deflection electrode 64 first (via input 402) enables the small filament 72. In addition, the order in which the side deflection electrodes 64, 68 are powered determines to which side deflection electrode the center deflection electrode 66 is shorted.

Figure 5A:
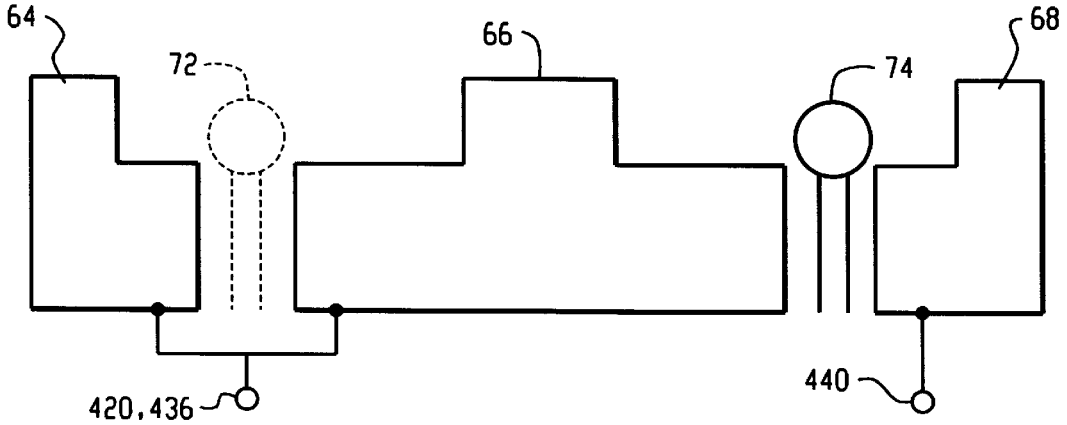
FIGS. 5A and 5B are diagrammatic illustrations of electrical switching by the filament select circuit in accordance with the present invention.

For example, to selectively excite the large filament 74 (at output 424), the large deflection electrode 68 is powered up first (at input 414). This action controls a relay coil 450 opening contact 452 within the filament select circuit 80 to disable the small filament selection circuit. In addition, the common deflection electrode 66 (at output 436) is shorted to the small deflection electrode 64 (at output 420), as shown in FIG. 5A. It is to be appreciated that this allows for finer control of the electron beam position and width as it strikes the rotating anode. Preferably, the voltages on the now "two deflection electrodes," the large deflection electrode 68 and the combination deflection electrode 64, 66, are varied in the form of a square wave having a 180° phase shift between the two electrodes. It is to be appreciated that the electrode voltages may be varied according to other waveforms as well. Oscillating the voltages on the deflection electrodes causes the electron beam to oscillate between two impingement positions.

Figure 5B:
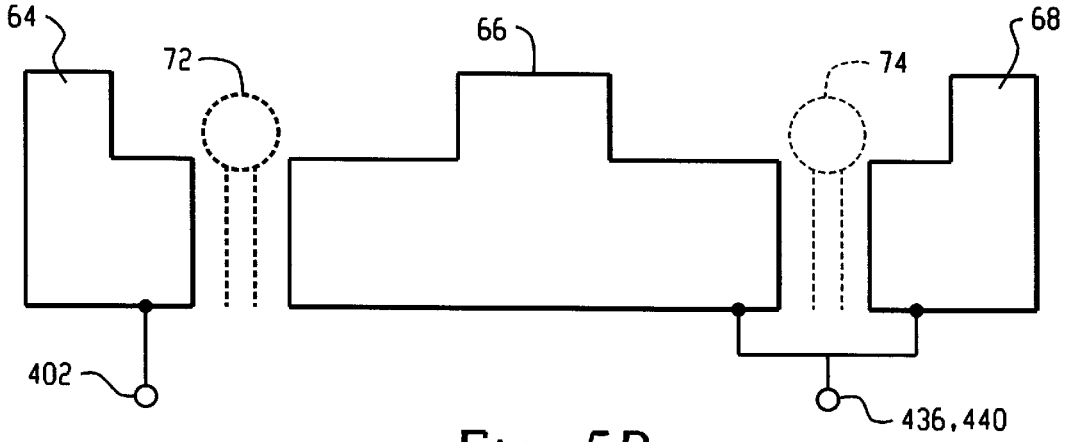

To selectively excite the small filament 72 (at output 428), the small deflection electrode 64 is powered. This action powers the relay coil 460 opening normally closed contacts 462, 464 and 466 and closing normally open contacts 468 and 470 within the filament select circuit 80. This routes the hot lead of the filament power supply (at input 406) to the small filament 72 (at output 428) and blocks the large filament 72 from receiving any current. In addition, contacts 470 short the common deflection electrode 66 (at output 436) to the large deflection electrode 68 (at output 440), as shown in FIG. 5B, allowing for finer control of the electron beam position and width. Preferably, the voltages on the now "two deflection electrodes," the small deflection electrode 64 and the combination deflection electrode 66, 68, are varied in the form of a square wave having a 180° phase shift between the two electrodes. It is to be appreciated that the electrode voltages may be varied according to other waveforms as well.

Figure 6:
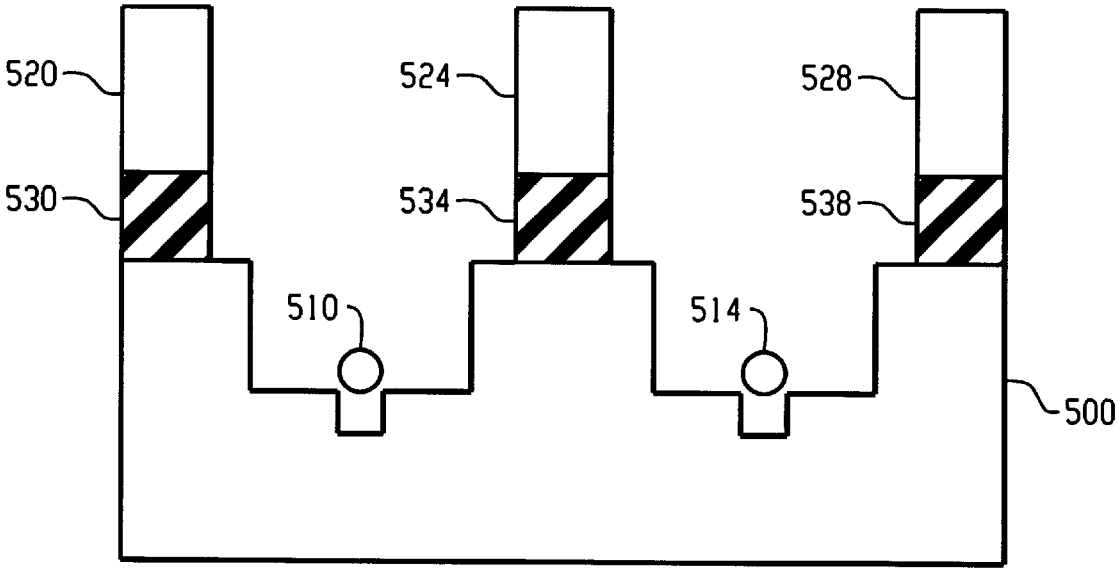
FIG. 6 is an alternate embodiment of the cathode assembly in accordance with the present invention.

FIG. 6 illustrates an alternative embodiment of the cathode assembly. More particularly, FIG. 6 provides a stair-stepped cathode base portion 500 housing two filaments 510, 514, which are insulated from the base portion 500. The side and center deflection electrodes 520, 524, 528 are electrically insulated from the base portion 500 by a plurality of insulating layers 530, 534, 538. Alternatively, the last two steps of the base portion are suppressed and completely replaced by the electrically insulated side and center deflection electrodes.

Figure 7:
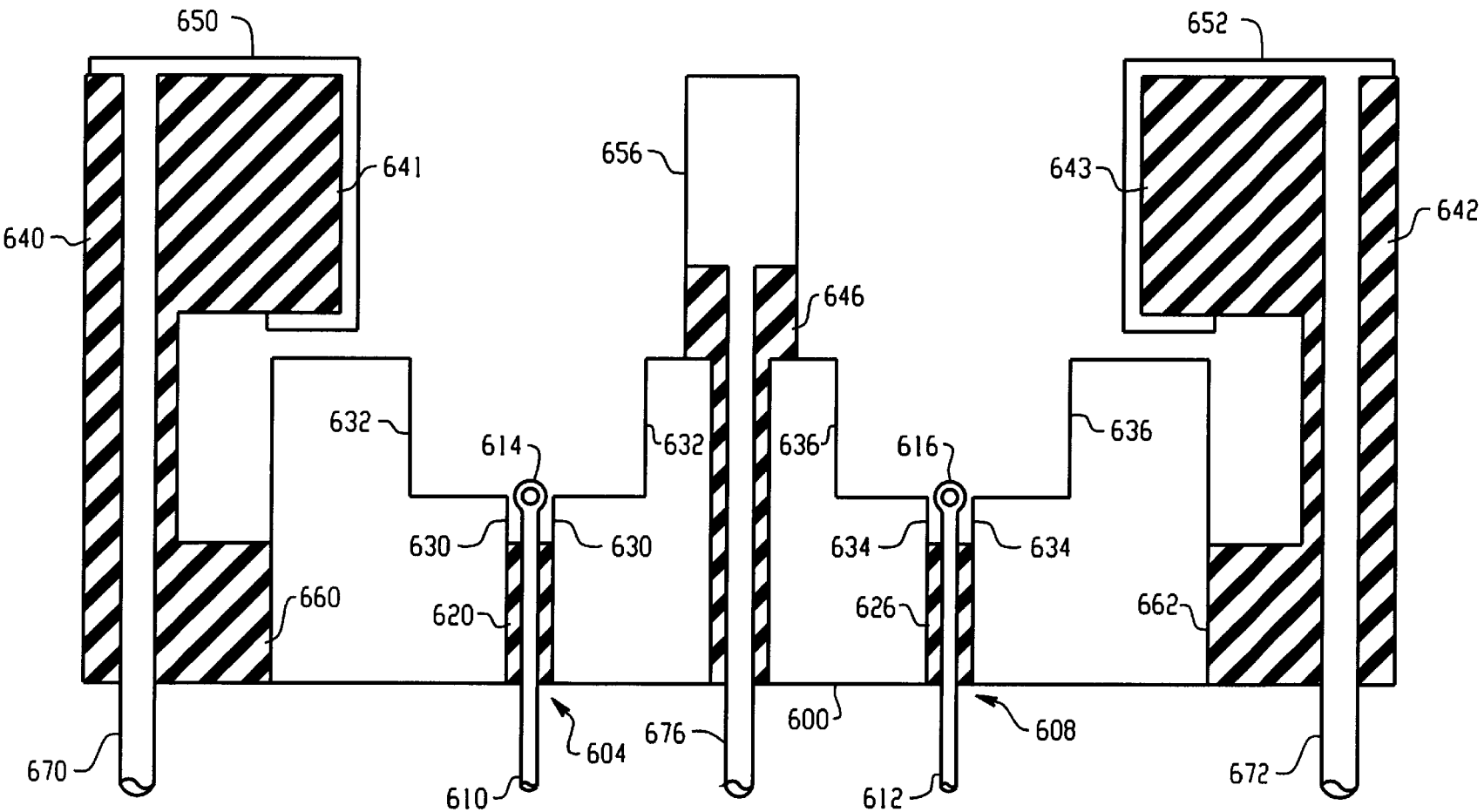
FIG. 7 is an alternate embodiment of the cathode assembly in accordance with the present invention.

FIG. 7 illustrates an alternative embodiment of the cathode assembly which includes a metallic base portion 600 pierced with at least two bore 604, 608 and at least one additional bore (not shown) through which leads 610, 612 for supplying current to at least two filaments 614, 616 are passed. The leads are insulated from the metallic base portion by insulator sleeves 620, 626. The metallic base portion 600 is shaped near the filaments so as to form stair-steps 630, 632, 634, 636, which place the edges of the base portion at a distance from the filaments 614, 616.

Insulating elements 640, 642 are fixed on the external lateral faces 660, 662 of the metallic base portion. The insulating elements 640, 642 provide support for the side deflection electrodes 650, 652. The insulating elements 640, 642 are shaped to have on the sides nearest the filaments two opposite faces 641, 643, which are parallel to the steps 632, 636 of the base portion 600. The side deflection electrodes 650, 652 are deposited on the opposite faces as well as on the top surfaces and bottom surfaces of the insulating elements 640, 642. The side deflection electrodes are connected to voltages supplies (not shown) by means of conductors 670, 672, which pass through the insulating elements 640, 642.

A central deflection electrode 656 is located between the two filaments 614, 616. The central deflection electrode 656 is insulated from the base portion 600 by an insulating element 646. The central electrode is connected to a voltage supply by means of a conductor 676 which passes through and is insulated from the base portion 600 and the insulating sleeve 646.

It is to be appreciated that all of the aforementioned embodiments may be constructed in a variety of ways without departing from the scope of the present invention. In one embodiment, the deflection electrodes and cathode base portion are formed through metal deposition on a ceramic substrate. Alternatively, the cathode assembly consists of machined metal, insulator spacers, and hermetically sealed feed-throughs which house the filament and electrode leads.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. An x-ray tube assembly comprising:

an evacuated envelope;

an anode disposed at a first end of the evacuated envelope for rotation about an anode axis;

a cathode assembly disposed at a second end of the evacuated envelope, said cathode assembly emitting an electron beam which strikes the anode at a focal spot having a focal spot length and a focal spot width, said cathode assembly comprising:

a variable-length filament assembly which emits electron beams which impinge on the anode at focal spots having variable lengths;

a cathode cup which defines a plurality of electrostatic deflection electrodes, said plurality of electrodes being electrically insulated from each other; and a means for individually and selectively applying potentials to different ones of the electrostatic electrodes of the cathode cup for controlling the width and location of the focal spot on the anode.

2. The x-ray tube assembly according to claim 1, wherein the cathode assembly includes:

at least a first filament and a second filament, the first filament being longer than the second filament; and, the cathode cup which is subdivided into at least three parts, where the number of parts is one greater than the number of filaments, said at least three parts being electrically insulated from each other.

3. The x-ray tube assembly according to claim 2, wherein the cathode cup includes:

a first deflection electrode disposed adjacent the first filament;

a second deflection electrode disposed adjacent the second filament; and a common deflection electrode disposed between the first filament and the second filament.

4. The x-ray tube assembly according to claim 3, wherein the first and second deflection electrodes are electrically connected.

5. The x-ray tube assembly according to claim 2, wherein:

the first filament emits a beam of electrons which impinges on the anode at a focal spot having a first focal spot length; and, the second filament emits a beam of electrons which impinges on the anode at a focal spot having a second focal spot length, wherein the first focal spot length is greater than the second focal spot length.

6. The x-ray tube assembly according to claim 5, further comprising:

a filament select circuit disposed adjacent the evacuated envelope for selectively and individually heating one of the first filament and the second filament.

7. The x-ray tube assembly according to claim 6, wherein the filament select circuit includes:

a means for selectively heating the first filament for thick-slice CT scanning applications; and, a means for selectively heating the second filament for thin-slice CT scanning applications.

8. The x-ray tube assembly according to claim 1, wherein the cathode assembly includes:

a single filament having a filament length;

a plurality of filament leads in electrical communication with the filament, said filament leads being disposed about the filament length; and a cathode cup subdivided into two parts which are electrically insulated from each other.

9. The x-ray tube assembly according to claim 8, wherein the cathode assembly includes:

a first filament lead in electrical communication with opposite ends of the filament;

a common filament lead in electrical communication with a central part of the filament; and a second filament lead in electrical communication with two points along the filament between the ends and central part.

10. The x-ray tube assembly according to claim 9, further comprising:

a means for selectively electrically heating one of (i) the entire filament length, and (ii) a portion of the filament length.

11. The x-ray tube assembly according to claim 9, wherein:

in response to the electrical heating of the entire filament length, the filament emits a beam of electrons which impinges the anode at a focal spot having a first focal spot length; and, in response to the electrical heating of the portion of the filament length, the filament emits a beam of electrons which impinges the anode at a focal spot having a second focal spot length, wherein the first focal spot length is greater than the second focal spot length.

12. An x-ray tube comprising:

a cathode assembly having:

a long filament portion and a short filament portion;

a common electrostatic deflection electrode disposed between the long and short filament portions;

a first electrostatic deflection electrode disposed adjacent the long filament portion opposite the common electrode;

a second electrostatic deflection electrode disposed adjacent the short filament portion opposite the common electrode;

an anode; and a vacuum enclosure enclosing the cathode assembly and the anode.

13. The x-ray tube assembly according to claim 12, further comprising:

not more than four leads through the vacuum enclosure for selectively supplying power to one of the long and short filament portions and biasing potentials between the common and at least one of the first and second electrodes.

14. The x-ray tube assembly according to claim 13, further comprising:

a filament select circuit disposed adjacent the vacuum enclosure for selectively powering one of the long and short filament portions and biasing the electrostatic deflection electrodes, said filament select circuit receiving the four leads as inputs and having at least five output leads in electrical contact with the filament portions and electrostatic deflection electrodes of the cathode assembly.

15. The x-ray tube assembly according to claim 12, wherein the first and second electrostatic deflection electrodes are electrically connected.

16. The x-ray tube assembly according to claim 12, wherein the cathode assembly includes:

a base portion which houses the long and short filament portions, said long and short filament portions being electrically insulated from the base portion;

wherein the first, second, and common electrostatic deflection electrodes are electrically insulated from the base portion.

17. The x-ray tube assembly according to claim 12, wherein the cathode assembly includes:

a base portion which houses the long and short filament portions, said long and short filament portions being electrically insulated from the base portion;

at least two insulating elements attached to lateral faces of the base portion, wherein the first and second deflection electrodes comprise L-shaped metallic plates attached to the two insulating elements.

18. The x-ray tube assembly according to claim 12, further comprising:

a filament select circuit disposed adjacent the vacuum enclosure for selectively powering one of the long and short filament portions and biasing the electrostatic deflection electrodes, wherein the filament select circuit includes a plurality of relay coils and corresponding electrical contacts for selectively powering the filament portions and biasing the deflection electrodes.

19. The x-ray tube assembly according to claim 12, wherein the cathode assembly includes:

a cathode cup which is divided into the first, second, and common electrostatic deflection electrodes, said deflection electrodes being electrically insulated from each other.

20. An x-ray tube with an adjustable length and width focal spot comprising:

an anode;

a cathode assembly including at least two filament segments and electrostatic deflection electrodes;

a vacuum envelope surrounding the cathode assembly and the anode;

not more than four leads passing through the vacuum envelope to supply electrical power to the filament sections and bias potentials to the electrodes; and a filament selection circuit disposed inside the vacuum envelope in connection with the four leads passing through the vacuum envelope, the filament selection circuit being connected with the filament segments for applying electric current selectively through a long section of filament and a short section of filament for controlling focal spot length and being connected with the electrodes for selecting focal spot width and position.

21. The x-ray tube according to claim 20, wherein the cathode assembly includes:

a common electrostatic deflection electrode disposed between the long and short sections of filament;

a first electrostatic deflection electrode disposed adjacent the long section of filament opposite the common electrode;

a second electrostatic deflection electrode disposed adjacent the short section of filament opposite the common electrode;

wherein the first and second electrostatic deflection electrodes are electrically connected.

22. The x-ray tube according to claim 20, wherein the cathode assembly includes:

a single filament having a long filament segment and a short filament segment;

a first filament lead in electrical communication with ends of the long segment of the filament;

a common filament lead in electrical communication with a central part of the filament;

a second filament lead in electrical communication with two points along the short segment of the filament between the ends and central part; and first and second electrostatic deflection electrodes disposed adjacent the filament on opposite sides.

23. In an x-ray tube assembly comprising an evacuated envelope having an electron-emitting cathode assembly spaced apart from a rotating anode, said cathode assembly including at least a first filament and a second filament for emitting electrons in a beam which impinges on the anode at a focal spot having a variable length and a variable width, a cathode cup which is subdivided into at least three electrically insulated deflection electrodes, and a filament select circuit disposed adjacent the evacuated envelope, said filament select circuit comprising:

means for selectively and individually electrically heating one of the first and second filaments; and, means for individually and selectively applying potentials to different ones of the deflection electrodes for controlling a width and location of a focal spot on the anode.

24. The filament select circuit according to claim 23, further comprising:

means for selectively heating the first filament for thick-slice CT scanning; and, means for selectively heating the second filament for thin-slice CT scanning.

25. A computerized tomographic (CT) system comprising:

an x-ray tube having an adjustable length and width focal spot for transmitting radiation through a subject disposed in a subject receiving aperture, said x-ray tube comprising:

an anode;

a cathode assembly including at least two filament segments and electrostatic deflection electrodes;

a vacuum envelope surrounding the cathode assembly and the anode;

not more than four leads passing through the vacuum envelope to supply electrical power to the filament sections and bias potentials to the electrodes; and a filament selection circuit disposed inside the vacuum envelope in connection with the four leads passing through the vacuum envelope, the filament selection circuit being connected with the filament segments for applying electric current selectively through a long section of filament and a short section of filament for controlling focal spot length and being connected with the electrodes for selecting focal spot width and position;

detector means coupled to the x-ray tube for detecting radiation emitted from the x-ray tube after passage of the radiation through the subject;

a rotatable gantry on which the x-ray tube and detector means are mounted; and, means for processing the detected radiation into a tomographic image representation.

26. A computerized tomographic system comprising:

a source of penetrating radiation for transmitting radiation through a subject disposed in a subject receiving aperture, said source of penetrating radiation including:

an evacuated envelope;

an anode disposed at a first end of the evacuated envelope;

a cathode assembly disposed at a second end of the evacuated envelope, said cathode assembly comprising:

a cathode base portion;

at least a first filament and a second filament, where the first filament is longer than the second filament; and at least three deflection electrodes being attached to and electrically insulated from the cathode base portion; and, means for individually and selectively applying potentials to different ones of the deflection electrodes;

detector means coupled to the source for detecting radiation emitted from the source after passage of the radiation through the subject;

a rotatable gantry on which the source and detector means are mounted; and, means for processing the detected radiation into a tomographic image representation.

27. A computerized tomographic (CT) system comprising:

a source of penetrating radiation for transmitting radiation through a subject disposed in a subject receiving aperture, said source of penetrating radiation including:

an evacuated envelope;

an anode disposed at a first end of the evacuated envelope;

a cathode assembly disposed at a second end of the evacuated envelope, said cathode assembly comprising:

at least a first filament and a second filament, where the first filament is longer than the second filament; and a cathode cup which is subdivided into a plurality of parts, said plurality of parts being electrically insulated from each other; and means for individually and selectively applying potentials to different ones of the parts of the cathode cup;

detector means coupled to the source for detecting radiation emitted from the source after passage of the radiation through the subject;

a rotatable gantry on which the source and detector means are mounted; and, means for processing the detected radiation into a tomographic image representation.

28. The CT system according to claim 27, further comprising:

a filament select circuit disposed adjacent the evacuated envelope for selectively and individually heating one of the first filament and the second filament.

29. A method of operating an x-ray tube comprising an evacuated envelope having a cathode spaced apart from an anode adapted to be maintained at a positive voltage relative to the cathode, said cathode comprising a filament assembly for selectively emitting electrons in a beam which impinges on the anode at a focal spot having at least one of a long focal spot length and a short focal spot length and a variable focal spot width, a cathode cup having a plurality of parts electrically insulated from each other, said method comprising the steps of:

selectively heating a portion of the filament assembly to emit electrons in a beam having one of (i) the short focal spot length, and (2) the long focal spot length; and, individually and selectively applying potentials to different ones of the cathode cup parts for controlling the width and location of the focal spot on the anode.

30. The method according to claim 29, wherein for a variable-length filament assembly including at least a first filament and a second filament, said first filament having a greater length than said second filament, the selectively heating step includes:

electrically heating one of the first filament and the second filament.

31. The method according to claim 30, wherein the electrically heating step includes:

electrically heating the first filament for thick-slice CT scanning; and electrically heating the second filament for thin-slice CT scanning.

32. The method according to claim 30, wherein for a cathode cup which includes (i) a first deflection electrode disposed adjacent the first filament; (ii) a second deflection electrode disposed adjacent the second filament; and (iii) a common deflection electrode disposed between the first filament and the second filament, the step of applying potentials including:

electrically connecting the common deflection electrode to one of the grid electrodes; and, applying a potential between the other deflection electrode and the common electrode.

33. The method according to claim 32, wherein the potential applying step includes:

electrically connecting the first deflection electrode to the second deflection electrode; and, applying a potential across the connected first and second electrodes and the common electrode.

34. The method according to claim 32, wherein the step of individually and selectively applying potentials to different ones of the cathode cup parts includes:

applying a potential to the first deflection electrode which is negative with respect to a potential applied to one of the first and second filaments and said second deflection electrode for shifting the location of the focal spot in a direction along the anode toward the second deflection electrode.

35. The method according to claim 29, wherein the filament assembly includes a single filament having a filament length, and (i) a first filament lead in electrical communication with a first end of the filament; (ii) a second filament lead in electrical communication with a second end of the filament; and (iii) a third filament lead in electrical communication with the filament at a point between the first filament lead and the second filament lead, the selectively heating step includes:

electrically heating one of (i) the entire filament length, said length being disposed between the first and second filament leads, and (ii) a portion of the filament length, said portion being disposed between the third and second filament leads.

* * * * *